US009512664B2

(12) United States Patent
Jasper

(10) Patent No.: US 9,512,664 B2
(45) Date of Patent: Dec. 6, 2016

(54) APPARATUS AND METHOD FOR PREVENTING UNWANTED OPENING OF A LOCKED ENCLOSURE

(71) Applicant: Lockmasters Security Institute, Inc., Nicholasville, KY (US)

(72) Inventor: Thomas E. Jasper, Bryantsville, KY (US)

(73) Assignee: Lockmasters Security Institute, Inc., Nicholasville, KY (US)

( * ) Notice: Subject to any disclaimer, the term of this patent is extended or adjusted under 35 U.S.C. 154(b) by 151 days.

(21) Appl. No.: 14/203,849

(22) Filed: Mar. 11, 2014

(65) Prior Publication Data

US 2014/0265361 A1 Sep. 18, 2014

Related U.S. Application Data

(60) Provisional application No. 61/788,289, filed on Mar. 15, 2013.

(51) Int. Cl.

| | |
|---|---|
| ***E05B 63/00*** | (2006.01) |
| ***E05G 1/04*** | (2006.01) |
| ***E05B 65/00*** | (2006.01) |
| *E05C 1/00* | (2006.01) |

(52) U.S. Cl.

CPC ..... *E05G 1/04* (2013.01); *E05B 65/0082* (2013.01); *Y10T 292/0994* (2015.04)

(58) Field of Classification Search

CPC E05B 17/0062; E05B 17/2007; E05B 17/203; E05B 17/2034; E05B 17/2084; E05B 17/2092; E05B 65/0075; E05B 65/0082; E05G 1/04

USPC ..... 292/2, 3, 32–34, 37, 41, 42, 137, 170, 292/169, 171, 174, 175, 145, 150, 159, 292/138, DIG. 51, DIG. 65; 70/1.5, 1.7, 70/422, 416, 70/417, 333 R

See application file for complete search history.

(56) References Cited

U.S. PATENT DOCUMENTS

| | | | | |
|---|---|---|---|---|
| 1,613,755 A * | 1/1927 | Hunter | E05B 65/0082 70/1.5 |
| 2,726,625 A | 12/1955 | Evans | |
| 3,013,426 A | 12/1961 | Taylor | |
| 3,076,420 A | 2/1963 | McClellan | |
| 4,648,255 A | 3/1987 | Gartner | |
| 4,969,343 A * | 11/1990 | Luker | E05B 39/025 292/229 |
| 5,231,935 A * | 8/1993 | Oder | E05B 65/0082 109/59 R |

(Continued)

FOREIGN PATENT DOCUMENTS

| | | | |
|---|---|---|---|
| DE | 3241846 A1 * | 5/1984 | E05B 65/0082 |
| DE | 3841099 A1 | 6/1990 | |

(Continued)

*Primary Examiner* — Alyson M Merlino

(74) *Attorney, Agent, or Firm* — Wood Herron & Evans LLP

(57) ABSTRACT

An apparatus for preventing unwanted opening of a locked enclosure. The enclosure includes a lock, a door and a door bolt. The door is openable when the door bolt is retracted from a structure surrounding the enclosure. The apparatus includes a frangible guard plate, and an arm coupled to the guard plate by a spring. The arm is maintained in a first position under a bias of the spring. When the guard plate is fractured, the arm is free to move from the first position into a second position. The arm is positioned to engage the door bolt in the second position, thereby preventing retraction of the door bolt.

9 Claims, 7 Drawing Sheets

(56) References Cited

U.S. PATENT DOCUMENTS

| | | | | |
|---|---|---|---|---|
| 2012/0298019 | A1* | 11/2012 | Maniaci | E05G 1/04<br>109/59 T |
| 2013/0042657 | A1* | 2/2013 | Dehaven | E05B 17/0062<br>70/1.5 |

FOREIGN PATENT DOCUMENTS

| | | | |
|---|---|---|---|
| FR | 2712335 | A1 | 5/1995 |
| GB | 20877 | A | 0/1912 |
| GB | 2093905 | A | 9/1982 |

* cited by examiner

APPARATUS AND METHOD FOR PREVENTING UNWANTED OPENING OF A LOCKED ENCLOSURE

CROSS-REFERENCE TO RELATED APPLICATION

This application claims the priority of Application Ser. No. 61/788,289 filed Mar. 15, 2013, the disclosure of which is hereby incorporated by reference herein.

TECHNICAL FIELD

The present invention generally relates to an apparatus including frangible plates used to prevent unwanted opening of locked enclosures

BACKGROUND

Locks are widely used in order to protect the contents of an enclosure, such as a safe, room, dwelling or building. Very often the locks used include combination dials, which users rotate in order to enter a combination code. When the correct combination is entered, lock components move from locked to unlocked positions, thereby enabling the door of the enclosure to be opened and giving the user access to the contents of the enclosure. Because enclosures such as safes often contain valuables, unwanted and/or undesired users such as potential thieves may attempt to gain access to the contents by manipulating the lock. For example, thieves may drill holes into lock devices in order to compromise the lock. Therefore, there exists a need for an apparatus and method that thwarts such thieves attempting to access the contents of an enclosure surreptitiously using a tool, such as a drill.

SUMMARY

In one embodiment, an apparatus for preventing unwanted opening of a locked enclosure is provided. The enclosure includes a lock, a door and a door bolt. The door is openable when the door bolt is retracted from a structure surrounding the enclosure. The apparatus includes a frangible guard plate and an arm coupled to the guard plate by a spring, thereby maintaining the arm in a first position under a bias of the spring. When the guard plate is fractured, the bias is released, thereby moving the arm into a second position. When the arm is in the second position, the arm is positioned to engage the door bolt, thereby preventing retraction of the door bolt.

In another embodiment, an apparatus for preventing unwanted opening of a locked enclosure including a lock mechanism is provided. The apparatus includes an arm having first and second ends and rotatably mounted at a point between the first and second ends. A first spring is operatively coupled to and rotatably biases the first end in a first direction. A second spring is operatively coupled to and rotatably biasing the second end in a second direction. A frangible guard plate is coupled to the first end of the arm by the first spring, thereby preventing rotation of the arm in the first direction from a first position to a second position. The arm in the second position is positioned to engage with a portion of the lock mechanism, thereby preventing the opening of the locked enclosure. When the frangible guard plate is fractured, the arm is free to move to the second position due at least in part to a second bias from the second spring.

In another embodiment, the apparatus includes a frangible guard plate and an arm coupled to the guard plate by a spring therebetween, thereby maintaining the arm in a first position due to a bias of the spring. The bias is in a direction transverse to a surface of the frangible plate. When the guard plate is fractured, the arm moves into a second position due to the bias being released. The arm engages with a member of the lock mechanism in the second position, thereby preventing the opening of the locked enclosure.

Methods of preventing unwanted opening of a locked enclosure are also disclosed. Various other details, embodiments and features are disclosed herein and are detailed below in conjunction with the accompanying drawings.

DETAILED DESCRIPTION

Figure 1:
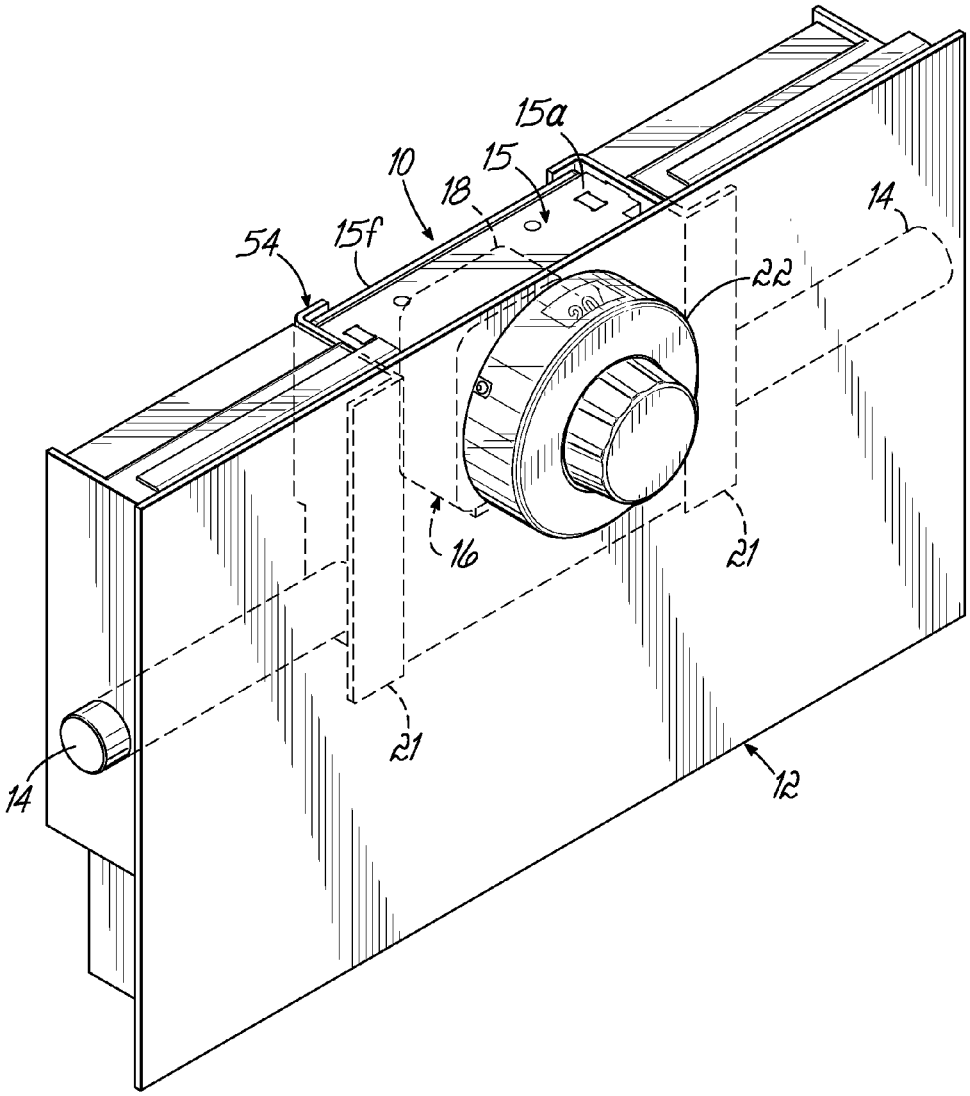
FIG. 1 is a front perspective view of an apparatus according to one embodiment of the invention.

An apparatus 10 for preventing unwanted opening of a locked enclosure is shown in FIGS. 1-4. The apparatus 10 is mounted within a door assembly including a door 12, a door bolt 14 and a lock 16. The lock 16 further includes a lock casing 18 (shown in hidden lines). A lock bolt 20 (FIG. 4) travels to a locked position in order to prevent movement of a door bolt 14. A combination dial 22, as described in more detail, is used to input a combination for purposes of moving the lock bolt 20 to an unlocked position. The apparatus 10 may contain multiple door bolts 14, both of which move in the direction of arrows 24 (FIGS. 4 and 5) when retracted from a door jamb, thereby enabling the opening of the door 12. However, in other embodiments, there may be less than or greater than two members such as door bolts 14. The retraction of door bolts 14 from a door jamb or safe housing, for example, enables a door 12 to be opened. The lock housing 15 includes top and bottom walls 15*a*, 15*b*, side walls 15*c*, 15*d*, and front and back walls 15*e*, 15*f*. The back wall 15*f* further includes a supplementary wall member 17 having apertures 19*a* to accept fasteners 19*b*. The lock housing 15 is fixed to a door 12 by a pair of support members 21. Each support member 21 has a door bolt aperture 25 for accepting the door bolt 14. Further, the side walls 15*c*, 15*d* include apertures 27 for accepting the door bolts 14. The door 12 is preferably hingedly mounted to a door jamb or a housing of a safe to prevent access to a locked room, dwelling or safe body. However, the door 12 may be mounted to other locked enclosures in order to prevent access into the enclosure.

Referring to FIGS. 2 through 6, the apparatus 10 includes a plurality of arms 26 having first and second ends 28, 30. Preferably, the apparatus 10 includes two arms 26. Alternatively, the apparatus 10 could include only one arm 26, or more than two arms 26. When the specification refers to an arm 26, it is contemplated that the details discussed also apply to embodiments having more than one arm 26, such as two arms 26, and vice versa.

The apparatus 10 further includes a frangible guard plate 32 which shatters into several pieces upon the occurrence of an attempt at accessing the lock 16 surreptitiously, such using a drill to drill a hole through the door 12 and lock 16. The guard plate 32 and the arm 26 are operatively coupled together such that the shattering of the frangible guard plate 32 frees the arms 26 for movement from a first position (FIG. 6A) to a second position (FIG. 6B). When the arm 26 is in the second position, the arm 26 moves into engagement with the door bolt 14 and prevents movement of the door bolt 14. This prevention of movement of the door bolt 14 prevents the door 12 from being opened regardless of whether the lock bolt 14 is in the unlocked or locked position.

The guard plate 32 comprises a material that, when subjected to outside mechanical forces, such as being contacted by a drill, shatters or breaks into several fragmented pieces. Materials with this characteristic are generally referred to in the art as frangible.

More specifically, the guard plate 32 includes slots 38 at each end. Each slot 38 accepts an engagement pin 40, which is coupled with a first end 28 of each arm 26 by a spring 42. The spring 42 is coupled at one end 42*a* to an aperture 44 in the first end 28 of the arm 26 and at a second end 42*b* to an aperture 46 (FIG. 6A) in the engagement pin 40. The coupling between the guard plate 32 and the first end 28 of the arm 26 maintains the arm 26 in the first position. The spring 42 is preferably a tension spring. The arm 26 is coupled to the guard plate 32 with the spring 42 such that the arm 26 is biased in a first direction by the tension spring 42. The guard plate 32 further includes a central aperture 39 which allows the combination dial 22 to couple with the lock 16, for example, by providing a mechanical or electrical connection through the aperture 39.

The arm 26 includes circular aperture 50 between the first and second ends 28, 30 which accepts a rotation pin 52. The rotation pin 52 is further accepted into an aperture 53 of a support member 54. Therefore, the arm 26 is rotatably coupled to the support member 54, and thus the housing 15, about an axis 55 transverse to the support member aperture 53. The arm 26 is essentially rotatably biased in the first direction (arrow 31) by the spring 42.

Figure 3B:
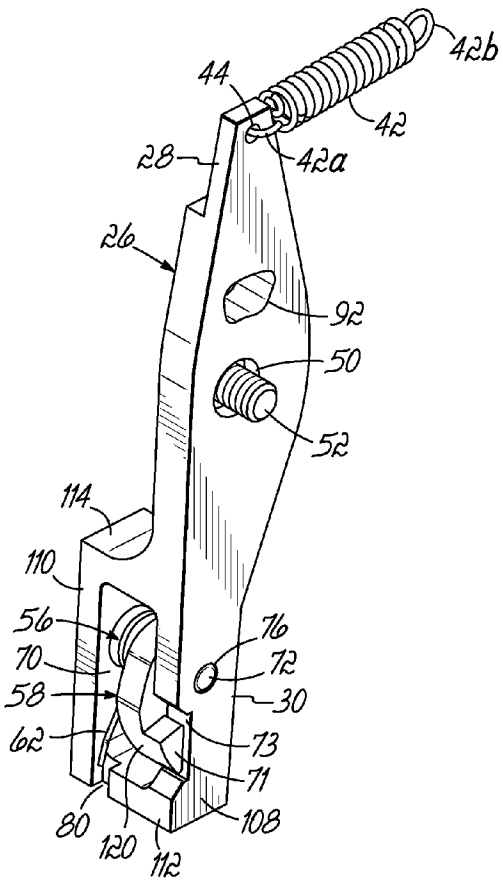
FIGS. 3A-3B show a detailed view of components of the apparatus of FIG. 1.
Figure 3A:
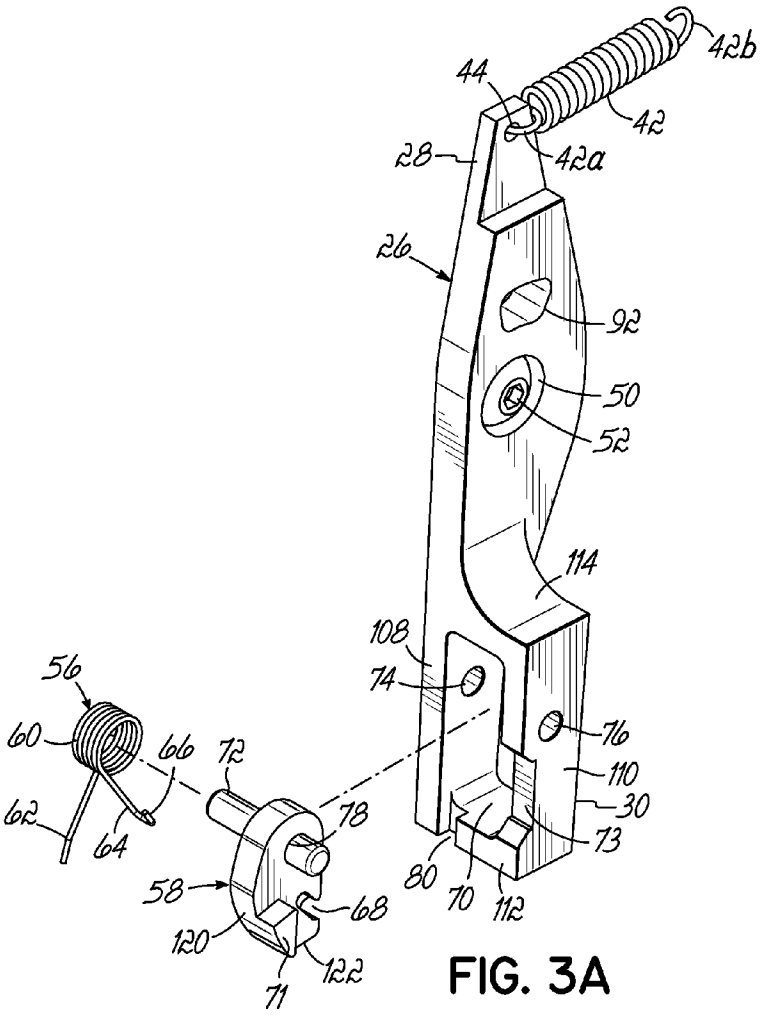

With reference to FIGS. 3A and 3B, further biasing the arm 26 in the first direction 31 is a second spring, preferably a torsion spring 56. The torsion spring 56 is operatively coupled with a cam member 58. The torsion spring 56 includes a wound portion 60 and first and second legs 62, 64. The second leg 64 includes a hooked portion 66. In a preferred embodiment, the cam member 58 is an eccentric cam. The hooked portion 66 of the second leg 64 engages with a notch 68 on the eccentric cam 58. The torsion spring 56 and the eccentric cam 58 are operatively coupled such that when the second leg 64 urges in one direction, the eccentric cam 58 is also urged in that direction (FIG. 6B).

With reference to FIG. 3B, the torsion spring 56 and eccentric cam 58 are operatively coupled to the arm 26. Specifically, the torsion spring 56 and eccentric cam 58 are accepted into a space 70 at the second end 30 of the arm 26. A cam pin 72 is accepted into medial 74 and lateral 76 apertures of the second end 30 of the arm 26. The cam pin 72 is also accepted into an aperture 78 in the cam 58 through the wound portion 60 of the torsion spring 56. The first leg 62 of the torsion spring 56 engages with a recess 80 in an inferior portion 112 of the second end 30. A generally triangular protrusion 71 interacts with a recess 73 in the lateral or medial portions 108, 110 of the arm 26, depending on the configuration of the arm 26 in the apparatus 10 (i.e., which side the arm is located, see FIGS. 3A and 3B). The interaction between the protrusion 71 and the recessed portion 73 prevents the rotation of the cam 58 in an unwanted direction. The interaction between the cam 58, torsion spring 56 and second end 30 of the arm 26 will be discussed below in more detail.

Figure 6A:
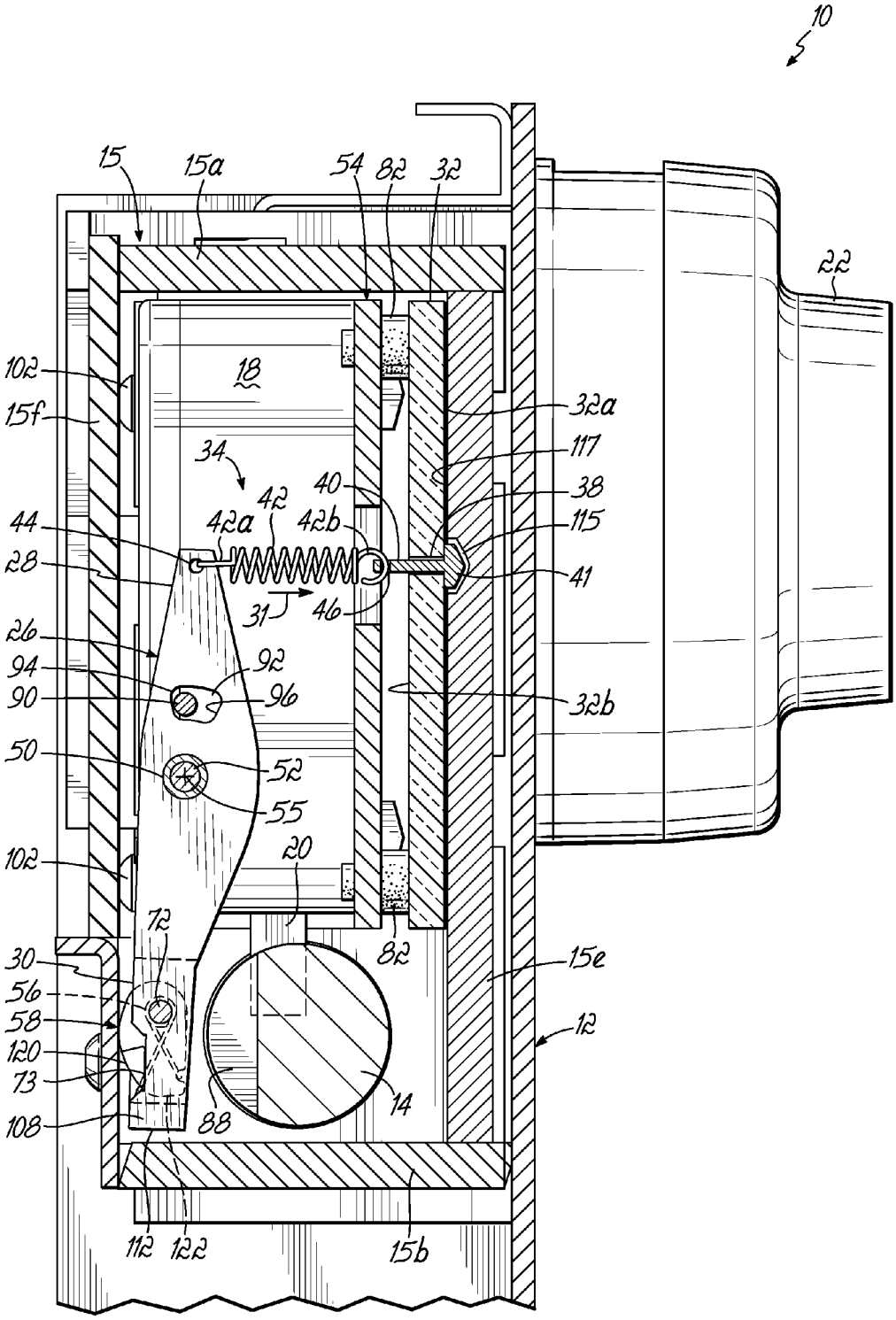
FIG. 6A is a side cross-sectional view of an apparatus according to one embodiment of the invention with the frangible guard plate in an intact configuration, taken along lines 6A-6A of FIG. 5.
Figure 6B:
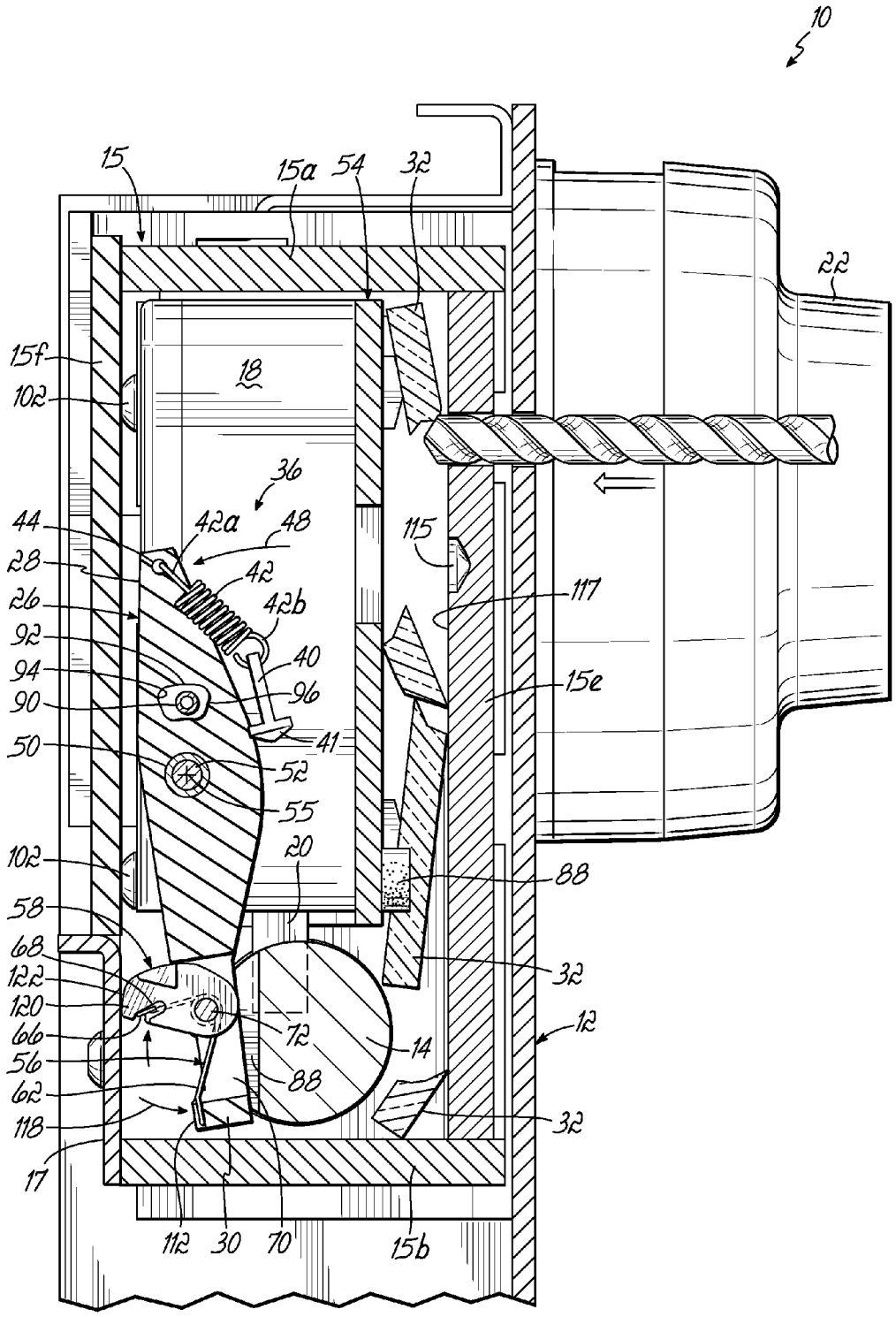
FIG. 6B is a side cross-sectional view of an apparatus according to one embodiment of the invention with the frangible guard plate in a broken configuration, taken along lines 6B-6B of FIG. 5.

The arm 26 is maintained in the first position 34 when the tension spring 42 is coupled to the guard plate 32 and the first end 28 of the arm 26 (FIG. 6A). The arm 26 is maintained in the first position due to the biases from the tension spring 42 and the torsion spring 56. Essentially, the reaction force holding the arm 26 in the first position 34 is greater than the sum of the biasing forces due to the tension and torsion springs 42, 56. Support pads 82 are provided to support the frangible guard plate 32. The pads 82 allow the guard plate 32 to undergo slight deformation so that the guard plate 32, which is comprised of a frangible material, does not shatter under the force of the tension spring 42. Engagement pin 40 may also be designed so that the area of the pin head 41 contacting the guard plate 32 is large enough to distribute the force in order to prevent unwanted shattering of the guard plate 32.

When the frangible guard plate 32 shatters or breaks, the first end 28 of the arm 26 is freed, thereby freeing the arm 26 for movement from the first position 34. The bias from the tension and torsion springs 42, 56 and the interaction of the eccentric cam 58 with a wall 17 of the housing 15 urge the first end 28 of the arm 26 in the first direction 48 (FIG. 6B). As the first end 28 moves in the first direction 48, the arm rotates 26 about the axis 55 transverse to the aperture 53 of the support member 54. The rotation of the arm 26 moves the arm 26 to a second position 36 (FIG. 6B) where the second end 30 of the arm 26 engages with a recess 88 in the door bolt 14. When the second end 30 of the arm 26 engages the recess 88, the door bolt 14 is prevented from moving relative to a safe housing, for example, thereby preventing opening of the door 12. Rotation of the arm 26 is discussed in more detail with reference to FIGS. 6A and 6B.

The engagement of the second end 30 of the arm 26 with the door bolt 14 thereby limits the rotation of the arm 26. Further, limiting the rotation of the arm 26 is the interaction between the pin 90 on support member 54 and pin aperture 92 on the second end 30 of the arm 26. Specifically, pin aperture 92 accepts pin 90. When the arm 26 is in the first position, the pin 90 contacts the first inner end 94 of the pin aperture 92. When the arm 26 is in the second position 36, the pin 90 contacts the second inner end 96 of the pin aperture 92.

The apparatus 10 is mounted within a housing 15 of a lock 12 or door assembly 11. Apertures 53 accept rotation pins 52 of support member 54, which then couples arms 26 to the support member 54. Rotation pins 52 maintain arms 26 in a position relative to the support member 54, but still allow for rotation of the arms 26 about the axis 55 transverse to the support member aperture 53.

In order to couple with the housing, the support member 54 is placed relative to the housing 15 such that the apertures (not shown) of the support device 54 accepting fasteners 102 are concentric with apertures 100. Fasteners 102 are then used to couple the support member 54 to the housing 15.

FIGS. 3A and 3B show a detailed view of each arm 26. FIG. 3A shows an exploded, disassembled view with the cam member 58 and torsion spring 56 exploded out of the space 70. First end 28 of each arm 26 comprises an aperture 44 for accepting a first hook 42*a* of tension spring 42. Tension spring 42 further includes a second hook 42*b* at an opposite end of the first hook 42*a*. As disclosed above, the second hook 42*b* couples with the engagement pin 40 to couple the first end 28 of the arm 26 and the frangible guard plate 32. The second end 30 of arm 26 comprises a space 70 for accepting the torsion spring 56, eccentric cam 58 and pin member 72. The space 70 is defined by lateral, medial, inferior and superior portions 108, 110, 112, 114 of the second end 30. The inferior and superior portions 112, 114 extend essentially transversely from the lateral portion 108. The medial portion 110 extends between the inferior and superior portions 112, 114. The lateral and medial portions 108, 110 include apertures 74, 76 for accepting pin member 72, which is also accepted into the wound portion 60 of torsion spring 56 and the cam aperture 78. In this configuration, the second end 30 of the arm 26 is coupled with the torsion spring 56 and eccentric cam 58.

Figure 4:
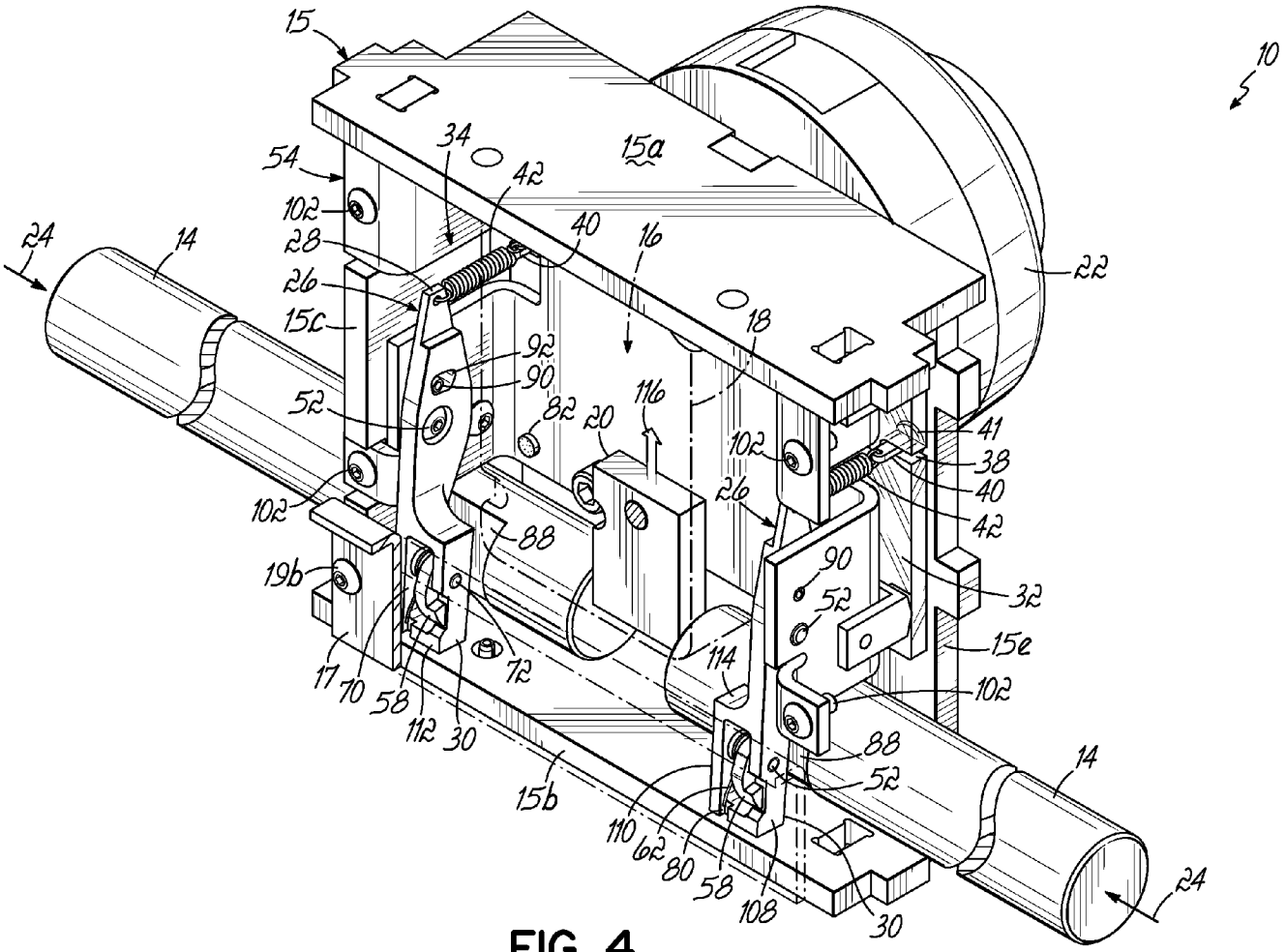
FIG. 4 is a rear perspective view of the apparatus to better show internal components.

With reference to FIG. 4, the lock 16 includes a support member 54 and a lock casing 18 (shown in phantom). The lock casing 18 is coupled to the support member 54. A lock bolt 14 is shown in the locked position, extending from the lock casing 18 (shown in phantom). In the locked position, the lock bolt 20 extends from the lock casing 18, thereby preventing movement of each door bolt 14 toward one another in the direction of arrows 24. The lock bolt 20 may move from the locked to the unlocked position upon a user inputting a correct combination on combination dial 22. Upon the input of a correct combination, the lock bolt 20 then retracts into lock casing 18 (shown in phantom) in direction of arrow 116. When the lock bolt 20 is in the unlocked position, door bolts 14 may move in the direction of arrows 24. Preferably, door bolts 14 moving in direction of arrows 24 retracts the door bolts 14 from an aperture in a door jamb 130 or safe housing (not shown), which then would allow the door 12 (FIG. 1) to be opened, thereby allowing access to the locked enclosure.

Alternatively, the apparatus 10 could be configured such that the arm 26 engages with the lock bolt 20 and prevents the movement of the lock bolt 20 from the locked to the unlocked position. In another alternative embodiment, the apparatus 10 could be configured such that the arm 26 or the arm 26 in conjunction with another member engages with a door jamb 130 or safe housing. The engagement of the arm 26 with a door jamb or safe housing, for example, would prevent the door 12 from being opened. In other words, the arm 26 or the arm 26 in conjunction with another member may act as a supplementary door bolt that, in one position, would prevent the opening of a door 12.

Figure 5:
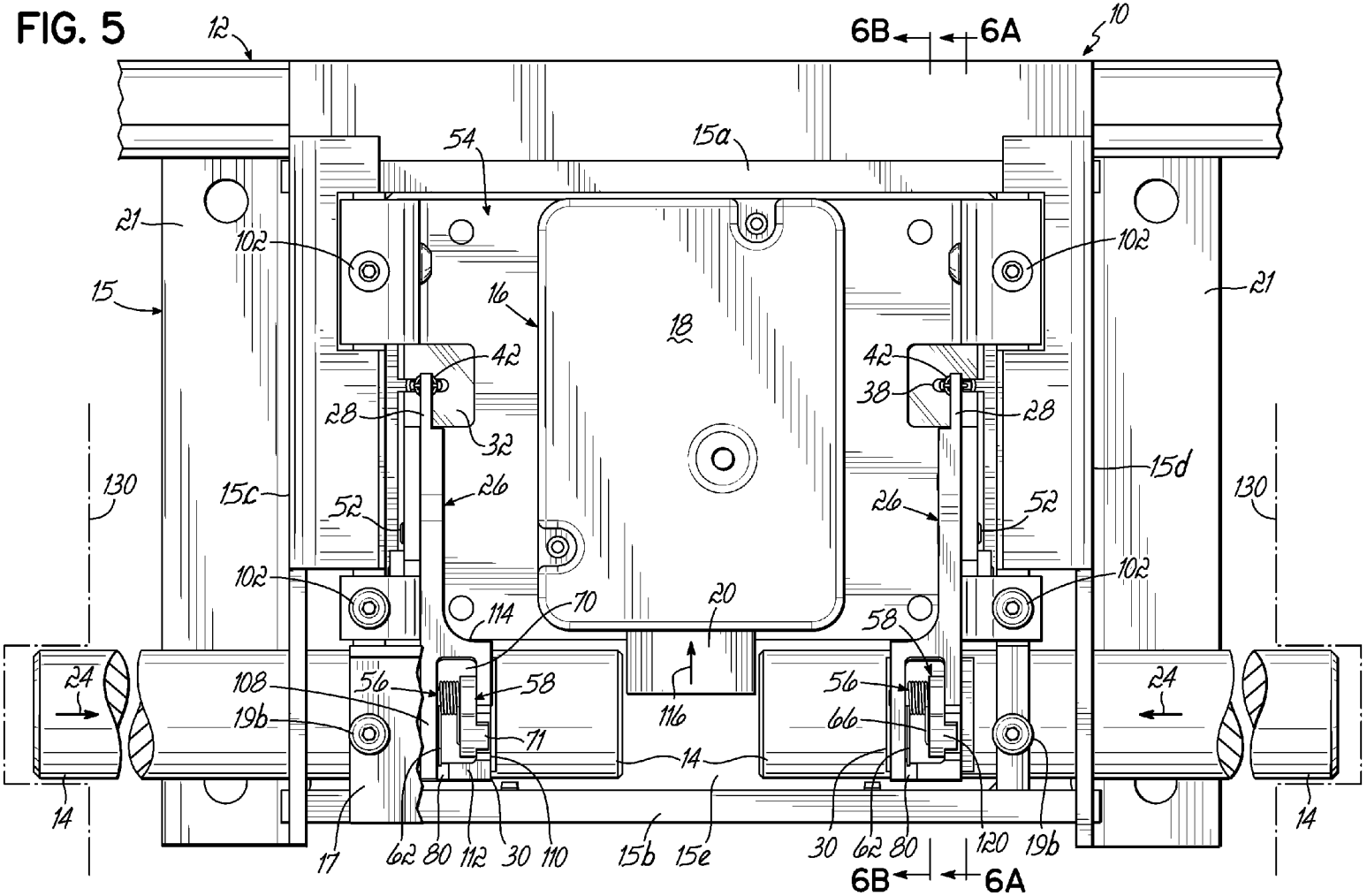
FIG. 5 is a rear view of the apparatus illustrating internal components.

FIGS. 4, 5 and 6A show the apparatus 10 with the arms 26 in the first position 34. The guard plate 32 is intact and engagement pin 40 is engaged through slot 38 of the guard plate 32. The pin 40 is coupled to the second hook 42*b* of tension spring 42, which is in tension. The coupling between the aperture 44 at the first end 28 of the arm 26 and the spring 42 maintains the arm in the first position. The tension spring 42 is configured such that the arm 26 is biased in a first direction as indicated by arrow 31. The torsion spring 56 and eccentric cam 58 are operatively coupled to the second end 30 of the arm 26. The guard plate 32 is disposed in the housing 15 adjacent a front wall 15*e* of the housing 15 such that a front side 32*a* of the guard plate 32 is essentially in contact with the front wall 117. The front wall 15*e* has a space or cavity 115 for the head 41 of the engagement pin 40 when the slot 38 receives the pin 40 and the frangible guard plate 32 is intact. The back side 32*b* of the guard plate 32 is supported within the housing 15 by a plurality of support pads 82, which are fixed to support member 32 within the housing 15. The pads 82 provide support for the guard plate 32 within the housing 15 and also prevent undesired shattering of the guard plate 32.

Figure 2:
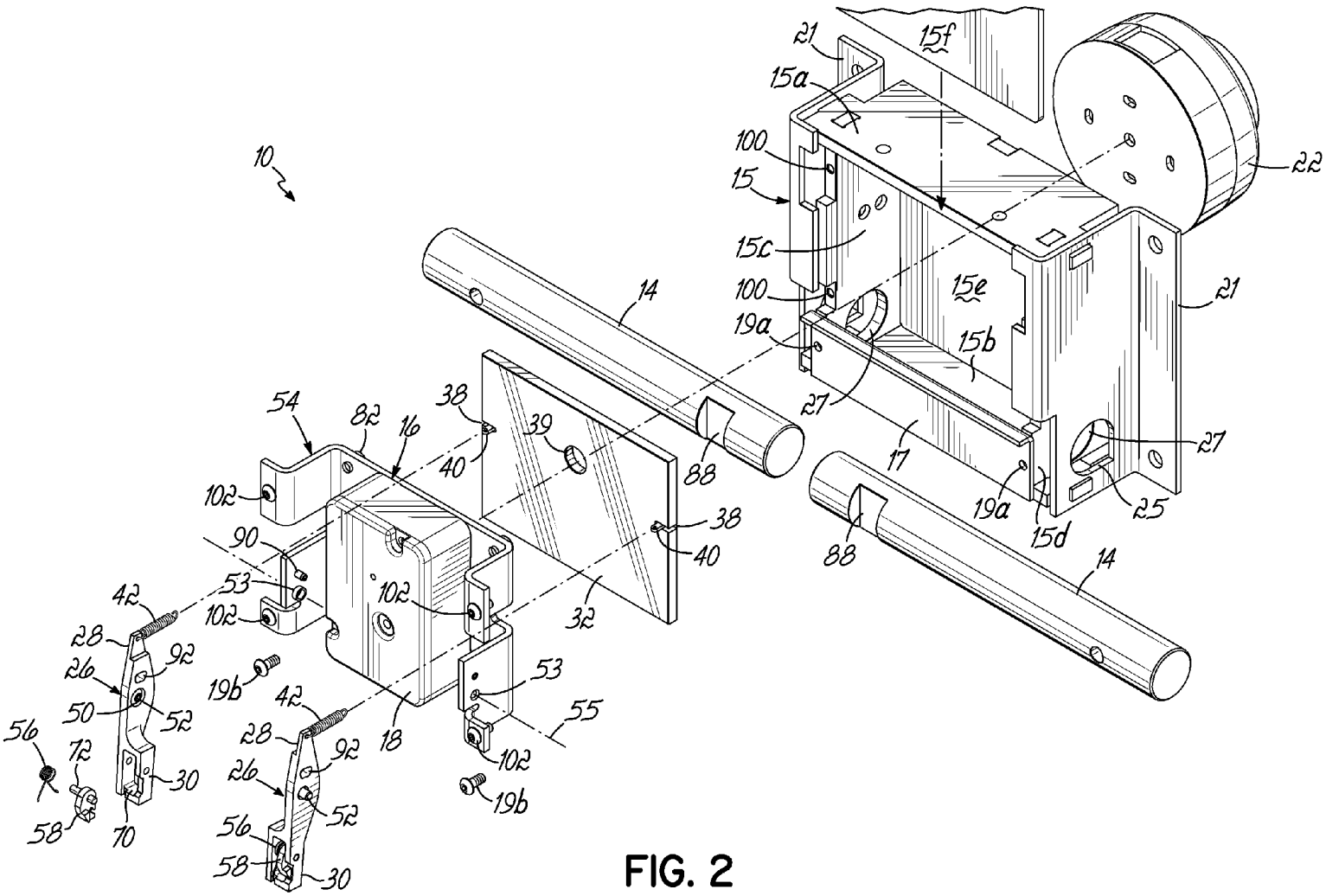
FIG. 2 is an exploded perspective view of the apparatus according of FIG. 1.

With reference to FIG. 6B (which shows a side cross sectional view more inward of the apparatus than shown in FIG. 6A), when the frangible guard plate 32 is broken, the engagement pin 40 is released, thereby freeing the arm 26 for rotational movement about the axis 55, which is transverse to the support member aperture 53 (FIG. 2). Due to the bias of the tension spring 42 being released upon the shattering of the guard plate 32, the arm 26 rotates about the axis 55. The rotation of the arm is further accomplished by the relationship between the second end 30 of the arm 26, the torsion spring 56 and the eccentric cam 58. Once the tension spring 42 is freed for movement, the bias of the torsion spring 56 causes the further rotation of the arm 26. Specifically, the first leg 62, which engages a recess 88 of the inferior portion 112 of the second end 30 of the arm 26, is urged in a direction as indicated by arrow 118 in the direction of the door bolt 14. Due to the engagement of the first leg 62 with the recess 88 of the inferior 112 portion of the second end 30 of the arm 26, the second end 30 of the arm 26 is also urged in the direction of arrow 118 towards the door bolt 14.

The interaction between the eccentric cam 58 and the support member 54 causes the second end 30 of the arm 26 to be further urged towards the door bolt recess 88. When the pin 40 is released upon the shattering of the guard plate 32, the bias of the torsion spring 56 causes the movement of the second leg 64 of the torsion spring 56. Due to the coupling of the hooked portion 66 of the second leg 64, torsion spring 56 and the notch 68 of the eccentric cam 58, the eccentric cam 58 is urged in the same direction as the movement of the second leg 64. This movement causes the eccentric cam 58 to interact with the support member 54 such that in the first position (FIG. 6A), the elongate lobed portion 120 interacts with the support member 54. As the cam 58 further rotates and the arm 26 reaches the second position 36, the bottom lobe portion 122 of the cam 58 is contacting the support member 54. Due to the eccentric configuration and the lobed shape of the cam 58, and the coupling between the cam 58 and the engagement pin 40, the eccentric cam 58 urges the second end 30 of the arm 26 towards the recess 88 in the door bolt 14. The arm 26 thus moves to the second position 36. As discussed previously, when the arm 26 is in the second position 36 and in engagement with the recess 88 in the door bolt 14, the door bolt 14 is prevented from moving in the direction of arrows 24 (FIGS. 4 and 5). This prevention of movement therefore prevents the door bolt 14 from retracting from a door jamb or safe housing (not shown), thereby preventing the opening of door 12 (FIG. 1).

In an alternative embodiment, the frangible guard plate 32 has a larger area relative to the housing than shown.

Furthermore, while the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope of the general inventive concept.

What is claimed is:

1. An apparatus for preventing unwanted opening of a locked enclosure including a lock mechanism, comprising:

an arm having first and second ends and rotatably mounted at a point between the first and second ends so as to be rotatable in a first direction between a first position and a second position;

a first spring operatively coupled to and rotatably biasing the first end in a second direction which is rotationally opposite to the first direction;

a second spring operatively coupled to and rotatably biasing the second end in the first direction; and a frangible guard plate coupled to the first end of the arm by the first spring, thereby preventing rotation of the second end of the arm in the second direction by the second spring so as to maintain the arm in the first position, wherein when the frangible guard plate is fractured, the arm is free to move from the first position to the second position due, at least in part, to the bias of the second spring on the second end of the arm such that when the arm is in the second position, the second end of the arm is positioned to engage with a portion of the lock mechanism, thereby preventing the unwanted opening of the locked.

2. The apparatus of claim 1, wherein the second spring is a torsion spring and the apparatus further comprises:

an eccentric cam operatively coupled to the arm and the torsion spring, wherein when the guard plate fractures, the torsion spring and the eccentric cam operate to rotate the arm to the second position.

3. The apparatus of claim 1, wherein a recoil of the first spring resulting from the guard plate fracturing assists in rotating the arm into the second position.

4. The apparatus of claim 2, further comprising:

a housing enveloping at least a portion of the lock mechanism, wherein the eccentric cam interacts with a portion of the housing so as to cause the arm to rotate to the second position.

5. A method of preventing unwanted opening of a locked enclosure including a lock, comprising:

rotatably mounting an arm to a housing at a point between first and second ends of the arm;

coupling the first end of the arm to a frangible guard plate with a first spring;

maintaining the arm in a first position relative to the frangible guard plate with the arm under a first bias of the first spring;

freeing the arm for rotation from the first position when the frangible guard plate is fractured such that the connection of the first end of the arm to the frangible guard plate by the first spring is released; and rotating the arm into a second position in engagement with a member of the lock, thereby preventing the unwanted opening of the locked enclosure.

6. The method of claim 5, further comprising a second spring at the second end of the arm and wherein the rotating step further comprises:

rotating the arm under a second bias from the second spring to the second position.

7. The method of claim 6 wherein the second spring is a torsion spring and the method further comprises:

operatively coupling a cam to the arm and the torsion spring, the torsion spring and the cam being operable to rotate the arm to the second position.

8. The method of claim 6, wherein the rotating step is further due to recoil resulting from freeing the arm.

9. The method of claim 7, wherein the cam interacts with a portion of a housing of the lock so as to cause the arm to rotate to the second position.

* * * * *